US005165390A

United States Patent [19]

Fleetwood

[11] Patent Number: 5,165,390

[45] Date of Patent: Nov. 24, 1992

[54] BACK MASSAGE MACHINE WITH RECIPROCATING TROLLEY

[76] Inventor: Thomas A. Fleetwood, 1420 N. Pasadena, Mesa, Ariz. 85201

[21] Appl. No.: 621,600

[22] Filed: Dec. 3, 1990

[51] Int. Cl.[5] ..... A61H 1/00

[52] U.S. Cl. ..... 128/33

[58] Field of Search ..... 128/33, 66, 57, 51, 128/52, 60

[56] References Cited

U.S. PATENT DOCUMENTS

| | | | |
|---|---|---|---|
| 910,888 | 1/1909 | Wilson et al. | 128/33 |
| 2,819,713 | 1/1958 | Buck | 128/33 |
| 3,039,458 | 6/1962 | Hill | 128/33 |
| 3,405,709 | 10/1967 | Mathers | 128/33 |
| 3,882,856 | 5/1975 | Heuser | 128/33 |
| 4,576,149 | 3/1986 | Otuka | 128/33 |
| 4,586,493 | 5/1986 | Goodman | 128/33 |
| 4,976,256 | 12/1990 | Marlin | 128/33 |

*Primary Examiner*—Robert A. Hafer
*Assistant Examiner*—David J. Kenealy
*Attorney, Agent, or Firm*—Harry M. Weiss

[57] ABSTRACT

A massage machine is disclosed for massaging a person's back, as required for back trouble, therapy relaxation or the like. This machine has a framework, a covering having a sheet supporting the person, control means near the sheet, a pair of massage rollers disposed under and bearing against the sheet, a trolley supporting the rollers for lengthwise travel of the rollers, a drive for moving the trolley back and forth; and an adjusting means for repositioning the rollers transverse to the lengthwise travel thereof.

4 Claims, 2 Drawing Sheets

BACK MASSAGE MACHINE WITH RECIPROCATING TROLLEY

FIELD OF THE INVENTION

The invention generally relates to a back massage machine and method, and, in particular, the invention relates to a motorized back massage machine having back massage members with adjustable lengthwise and transverse drive means for massaging the back of a reclining person.

BACKGROUND OF THE INVENTION

In the past, people have generally needed and used the services of other people who have skill and training or experience in back massages to obtain relief and therapy associated with a back massage. Often, it was very difficult to obtain the services of such people because of the need to either travel to the facility of the person performing the back massage or the need for such a person to travel to the home or office of the person needing the back massage. Also, the cost associated with the back massage service was generally fairly expensive and, additionally, there was always the lack of privacy associated with having someone perform a back massage on another person.

Some persons require one or more back massages daily for a back problem, or medical problem, or the like. To fulfill this need and to overcome some of the above noted disadvantages of having a person perform a back massage for another person, a reliable back massage machine was required.

SUMMARY OF THE INVENTION

Accordingly, it is an object of this invention to provide an improved back massage machine and method therefor.

It is another object of this invention to provide an improved back massage machine and method therefor which permits a user to lie on his or her back and to actuate operation of the machine to achieve a back massage along the entire length of a the user's back.

BRIEF DESCRIPTION OF THE INVENTION

According to the present invention, a back massage machine and method is provided. This machine includes a support framework, a cover on Which a user can lie upon, a control means for controlling the machine, a pair of rollers for rolling on the underside of the cover on which the user lies for massaging the back of the user, a trolley for supporting the rollers during lengthwise back-and-forth travel of the trolley and rollers, a drive means for drawing the trolley, and adjusting means for setting the transverse locations of the rollers. By use of this back massage machine, the need for providing a stand alone, reliable, adjustable, and self-operable back massager for a person with a back problem, or desiring a back massage is satisfied.

The foregoing and other objects, features and advantages will be apparent from the following description of the preferred embodiment of the invention as illustrated in the accompanying drawings.

DESCRIPTION OF THE PREFERRED EMBODIMENT

Figure 1:
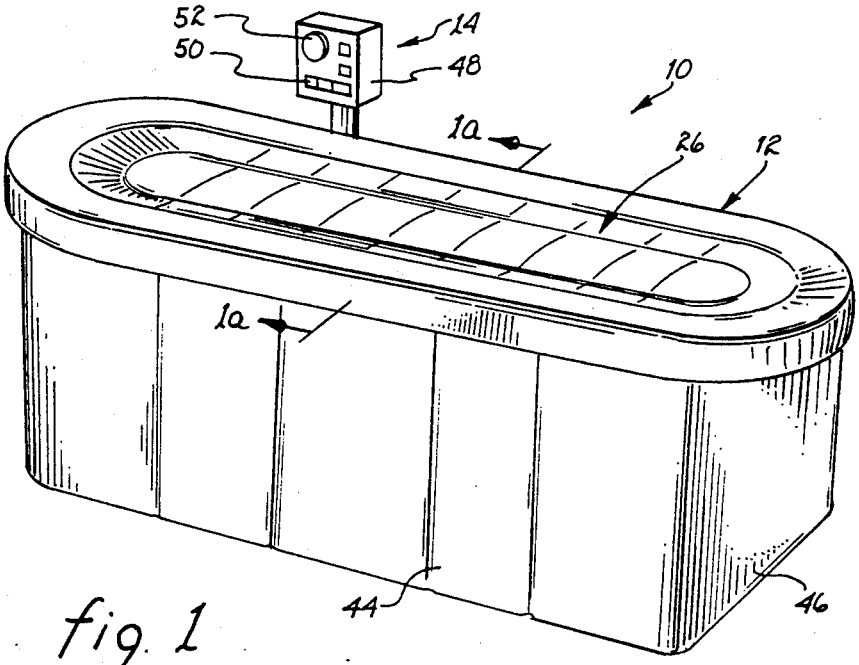
FIG. 1 is a perspective view of the back massage machine according to the invention.
Figure 2:
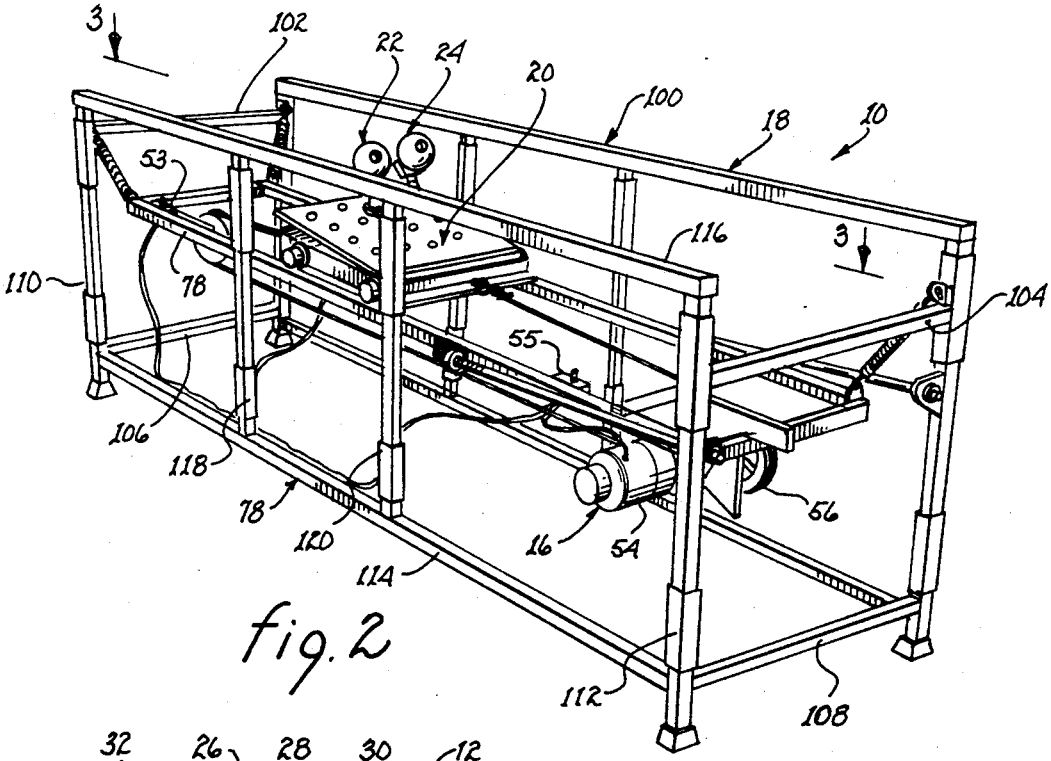
FIG. 2 is a perspective view of the framework of the machine of FIG. 1.

As shown in FIGS. 1 and 2, a back massage machine 10 is provided. Machine 10 includes a covering or cover 12, an electrical control means 14, a drive means 16 (see FIG. 2) operated by the electrical control means 14, a framework 18 for support, a trolley 20, and first and second rollers or resilient rolling spheres 22, 24 mechanically coupled to the trolley 20.

Figure 1A:
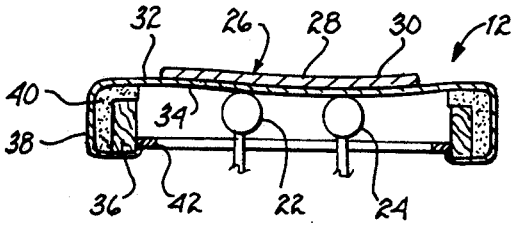
FIG. 1*a* is a section view as taken along the line 1*a*—1*a* of FIG. 1.

As shown in FIGS. 1 and 1*a*, covering 12 includes an upper subassembly 26. Subassembly 26 has a pad 28, which has an upper surface 30 that contacts a user, and has a sheet or covering 32, which has a lower surface 34 that contact spheres 22, 24. Covering 12 has an annular member 36, which is preferably made of wood, and which has a racetrack or oval shape. Sheet 32 has an edge portion 38. Edge portion 38, and a cushion strip 40, and an annular molding piece 42, are fixedly connected or attached to member 36. Covering 12 also includes a plurality of lower side panels 44 (see FIG. 1) and two lower end panels 46. Subassembly 26 and panels 44, 46 are removably attached to framework 18 by connectors (not shown) thereby permitting access into the interior of the back massage 10.

As shown in FIG. 1, control means 14 includes a control box 48, which has a plurality of control buttons 50, and a time control dial 52 for setting the amount of time that a person wants to use the back massage machine 10.

Figure 3:
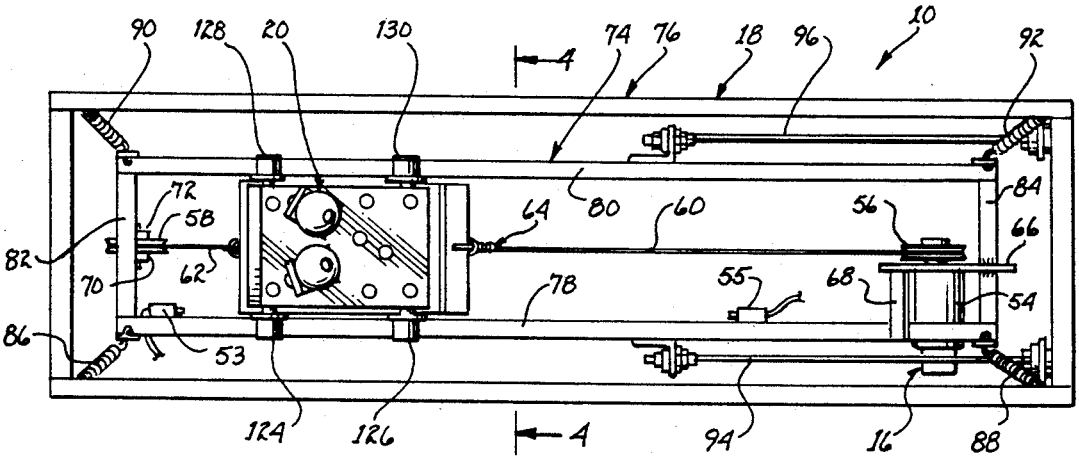
FIG. 3 is a top plan view as taken along the line 3—3 of FIG. 2.

As shown in FIGS. 2 and 3, drive means 16 includes a drive motor 54, which has preferably two reversing switches 53, 55, that are mounted on opposite ends of track 78. Motor 54 also has a drive pulley 56 coupled to an idler pulley 58 and a drive belt or cable 60 is actuated or driven by drive pulley 56. Cable 60 has opposite end portions 62, 64, which are connected to opposite ends of trolley 20, for pulling trolley 20 back-and-forth lengthwise, so that spheres 22, 24 massage the back of the user who is lying back down, on both sides of the spine and along the spine to the opposite ends of the spine.

Motor 54 and drive pulley 56 have a support plate 66 (see FIG. 3) and a tie member 68 which are supported onto or by framework 18. Idler pulley 58 has clip angle members 70, 72, which are attached to or supported by framework 18.

As shown in FIGS. 2 and 3, framework 18, which is preferably a metal framework, has a suspended inner subassembly 74 (see FIG. 3) and a stationary outer subassembly 76. Suspended subassembly 74, which supports motor 54, has lengthwise tracks 78, 80, that have end tie members 82, 84. Track 78 has left and right suspension springs 86, 88. Track 80 has left and right suspension springs 90, 92. Front and rear tracks 78, 80 have respective front and rear pivotable tie rods 94, 96 connected thereto. Rods 94, 96 prevent lengthwise movement by inner subassembly 74 and, but yet allow or permit vertical movement of subassembly 74. Springs 86, 88, 90, 92 stretch (due to the weight of the user on the spheres 22, 24 mounted on the trolley 20 which is mounted on the tracks 78, 80) and have spring rates to provide relatively small vertical movement of trolley 20 and spheres 22, 24 thereby maintaining spheres 22, 24 against the back of the user.

Stationary outer subassembly 76, which supports inner subassembly 74, has a front frame 98 and a rear frame 100 (see FIG. 2) which are preferably identical.

Frames 98, 100 have upper tie members 102, 104 and lower tie members 106, 108. Front frame 98 has left and right end vertical members or legs 110, 112 and have lower and upper horizontal members 114, 116 and have left and right intermediate vertical members 118, 120. Members 110, 112, 114, 118, 120, each preferably have welded or fixed connections at the ends thereof.

Figure 4:
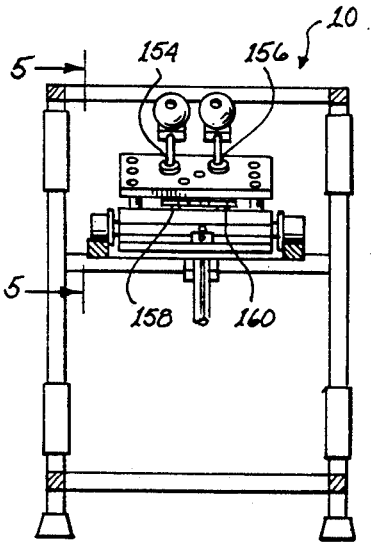
FIG. 4 is a side elevational view as taken along the line 4—4 of FIG. 3.
Figure 5:
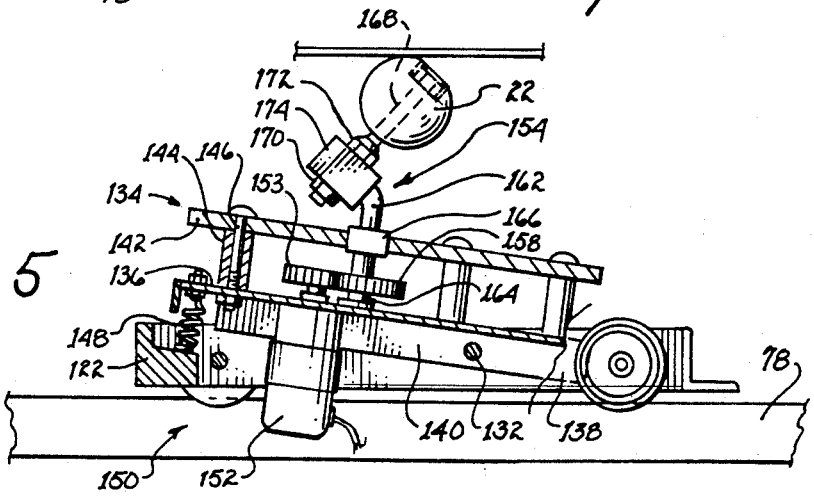
FIG. 5 is a side sectional view as taken along the line 5—5 of FIG. 4.

As shown in FIGS. 3, 4 and 5, trolley 20 has a four-sided frame 122 (see FIG. 5), which has front and rear pairs of wheels 124, 126 and 128, 130 (see FIG. 3). Trolley 20 also has an elongated hinge pin 132 (see FIG. 5, and a tilted plate subassembly 134 which can pivot relative to frame 122 about hinge pin 132. Plate subassembly 134 has a lower plate 136 with preferably welded stiffeners 138, 140 both of which are journaled on pin 132. Subassembly 134 also has an upper plate 142, and a plurality of spacers 144 connecting upper plate 142 to lower plate 136 by the use of bolts 146 nuts at the ends thereof. Subassembly 134 also has a helical spring 148, which allows mechanically coupled spheres 22, 24 to move vertically a relatively slight amount, in order to follow the contour of the body of the user.

Lower plate 136 supports a drive means 150 which has a drive motor 152 with a drive gear 153. Spheres 22, 24 have respective crank arms 154, 156 (see FIGS. 4 and 5) which have respective driven gears 158, 160 which mesh with each other. Motor gear 153 turns crank arms 154, 156 by means of causing driven gears 158, 160 to thereby turn turning crank arms 154, 156. Motor gear 153 spins gears 158, 160 in the opposite rotary directions, for changing the transverse locations of the spheres 22, 24.

As shown in FIG. 4, crank arms 154, 156 are identical. Crank arm 154 has a lower portion 162 (see FIG. 5) which is journaled in bearings 164, 166. Crank arm 154 has an upper portion 168, which has one portion that passes through and is fixedly connected by nuts 170, 172 to an enlarged end part of lower portion 162 and another portion that is attached by means to a nut to sphere 22.

Figure 6:
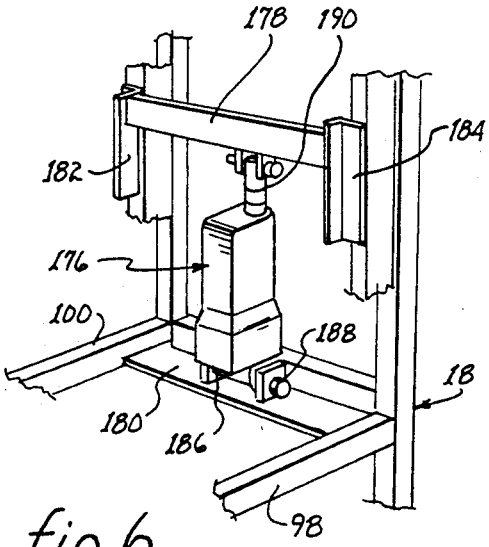
FIG. 6 is a perspective view of a vertical type lifting mechanism used in the back massage machine of this invention.

As shown in FIG. 6, a lifting fixture 176 is provided for raising and lowering an upper member 178 relative to a lower member 180. Lower member 180 is supported by framework 18. Upper member 178 has near and far guide plates 182, 184 at the respective ends thereof, so that upper member 178 is guided during vertical displacement thereof. Fixture 176 has a pair of lower hinges 186, 188 connected to lower member 180. Fixture 176 has an upper hinge 190, which is connected to upper member 178. Lower member 180 is connected to front and rear frames 98, 100 at ends thereof. Upper member 178 is connected to right tie member 84.

An identical lifting fixture is similarly mounted (not shown) at the left ends of frames 98, 100 and similarly connected to left tie member 82 for simultaneously raising and lowering the ends of suspended subassembly 74. Fixture 76 has three conditions, including upward movement condition, downward movement condition, and shutoff condition. In all positions or conditions, sheet 32 is fixed and taut.

OPERATION

The user pushes a control button to set the transverse position of spheres 22, 24. The user then turns time dial 52 to run trolley 20, which then moves back and forth along the rails 78, 80 under the control of the track switches 53, 55. Time dial 52 is also used to regulate the speed of trolley 20, and also to stop trolley 20. In this way spheres 22, 24 massage the back of the user through sheet 32 and pad 28.

The advantages of the back massage machine 10 are indicated hereafter.

A) Machine 10 fulfills the need of a person who requires daily massaging of the back, as required, for a back problem, or for relaxation, therapy or the like.

B) By the selective operation of lifting fixture 176 (and its counterpart lifting fixture) the height of the two spheres 22, 24 is adjustable to vary the pressure of the spheres on a person's back.

C) Trolley 20 continues to operate automatically for continuous lengthwise back and forth massage by spheres 22, 24 because of the action of switches 53, 55.

D) Trolley motor 152 can set a new transverse position of spheres 22, 24 while spheres 22, 24 continue to travel lengthwise back and forth for massaging the different back areas of the user.

While the invention has been described in its preferred embodiment, is to be understood that the words which have been used are words of description rather than limitation and that changes may be made within the purview of the appended claims without departing from the true scope and spirit of the invention in its broader aspects.

The embodiment of an invention in which an exclusive property or right is claimed are defined as follows.

I claim:

1. A back massage machine comprising:

a support framework;

a covering located on said support framework having sheet means for supporting a user;

control means located near to the sheet means for permitting a user to operate said back massage machine;

massage roller means disposed under the sheet means for massaging the back of the user;

trolley means for supporting and moving the massage roller means for lengthwise back-and-forth travel;

drive means mechanically coupled to said trolley means for driving said trolley means; and adjusting means for moving said massage roller means in a transverse direction both when said trolley means is moving in said lengthwise back-and-forth travel and when said trolley means is in a fixed position;

the massage roller means includes first and second spherical rollers spaced apart from each other;

the framework includes an inner suspended subassembly and an outer subassembly;

said suspended subassembly having a pair of lengthwise trolley tracks with cross ties and having a plurality of spring members respectively connected to the stationary subassembly and having pivotable elongate rod means to permit vertical displacement and to restrain horizontal placement of the inner suspended subassembly.

2. The machine of claim 1, wherein the outer stationary subassembly having first and second frames and having first and second pairs of end tie members, the frame having a plurality of vertical and horizontal members each having fixed end connections; said outer stationary subassembly supports the covering.

3. A back massage machine comprising:

a support framework;

a covering located on said support framework having sheet means for supporting a user;

control means located near to the sheet means for permitting a user to operate said back massage machine;

massage roller means disposed under the sheet means for massaging the back of the user;

trolley means for supporting and moving the massage roller means for lengthwise back-and-forth travel;

drive means mechanically coupled to said trolley means for driving said trolley means; and adjusting means for moving said massage roller means in a transverse direction both when said trolley means is moving in said lengthwise back-and-forth travel and when said trolley means is in a fixed position;

the massage roller means includes first and second spherical rollers spaced apart from each other;

the trolley means has a lower frame portion with trolley wheel means for riding on racks and having an upper plate portion with pivot means and spring means for respectively tilting and supporting the upper plate portion on the lower frame portion.

4. A back massage machine comprising:

a support framework;

a covering located on said support framework having sheet means for supporting a user;

control means located near to the sheet means for permitting a user to operate said back massage machine;

massage roller means disposed under the sheet means for massaging the back of the user, said massage roller means comprising first and second spherical spaced apart from each other;

trolley means for supporting and moving the massage roller means for lengthwise back-and-forth travel, said trolley means having a lower frame portion with trolley wheel means for riding on tracks and having an upper plate portion with pivot means and spring means for respectively tilting and supporting the upper plate portion on the lower frame portion;

drive means mechanically coupled to said trolley means for driving said trolley means; and adjusting means for setting a transverse position of the massage roller means, said adjusting means comprising a pair of crank arms with first ends respectively journaled in said spherical rollers and with second ends journaled in the upper plate portion and includes respective driven gears which mesh with each other and are fixed to the crank arms and includes a motor having a drive gear meshing with one of the two driven gears for transversely displacing the crank arm first ends and the spherical rollers coupled thereto.

* * * * *